US006089876A

United States Patent [19]

Kuwahara et al.

[11] Patent Number: 6,089,876

[45] **Date of Patent: *Jul. 18, 2000**

[54] CLIP CONNECTOR

[75] Inventors: Takashi Kuwahara, Akishima; Takasuke Omi, Tachikawa; Kazuaki Ibaraki, Higashimurayama; Hiroki Abe, Yamagata; Yoshiaki Ishiyama, Ebina; Masahiko Komachi, Akishima, all of Japan

[73] Assignee: Japan Aviation Electronics Industry, Limited, Tokyo, Japan

[ * ] Notice: This patent is subject to a terminal disclaimer.

[21] Appl. No.: 09/129,934

[22] Filed: Aug. 6, 1998

[30] Foreign Application Priority Data

Aug. 15, 1997 [JP] Japan ..... 9-220296

[51] Int. Cl.[7] ..... H01R 9/09

[52] U.S. Cl. ..... 439/67; 439/74

[58] Field of Search ..... 439/67, 493, 79, 439/74, 71

[56] References Cited

U.S. PATENT DOCUMENTS

| | | | |
|---|---|---|---|
| 5,209,671 | 5/1993 | Sugimoto et al. | 439/67 |
| 5,517,752 | 5/1996 | Sakata et al. | 439/67 |
| 5,888,076 | 3/1999 | Itoh et al. | 439/74 |

OTHER PUBLICATIONS

Bilsback et al, Plasmma Panel display Present Unique Packing Problem, IBM Corporation, Sep. 1986.

*Primary Examiner*—Renee Luebke
*Assistant Examiner*—J. F. Duverne
*Attorney, Agent, or Firm*—Laff, Whitesel & Saret, Ltd.; J. Warren Whitesel

[57] ABSTRACT

A connectable plate (2) is mounted on an upper surface of a horizontal portion (the uniform thickness portion) (1*b*) of a housing (1). A plurality of contacts (3) mounted on the housing come into contact with a pattern of the connectable plate. A clip (4) has a U-shaped cross-sectional configuration. A spacing of a resilient forked portion of the contacts (an opening width) is larger than the thickness of the connectable plate but smaller than the sum of the thickness of the connectable plate and the thickness of the uniform thickness portion. When the clip is mounted to the connectable plate and the housing, an insulating coating portion (4*d*) of the clip slides onto the upper surface of the connectable plate, and a connector-housing-side end portion (4*b*) of the clip presses against an inclined portion (1*a*) of the housing. Thus, the opening width of the clip becomes larger, so that the connector-housing-side end portion slides smoothly onto the lower surface of the uniform thickness portion. As a result, the clip holds the connectable plate and the housing, and does not cause damage to either the connectable plate or to the clip connector.

6 Claims, 7 Drawing Sheets

CLIP CONNECTOR

BACKGROUND OF THE INVENTION

1. Field of the Invention

This invention relates to a clip connector for supporting a connectable plate, and electrically and mechanically connecting a conductive portion of the connectable plate to a contact and, more particularly, to a clip connector which is suitable for electrically and mechanically connecting a conductive portion of a connectable plate, such as a liquid crystal glass plate or a liquid crystal film plate, to a conductive portion of a circuit board.

2. Description of the Related Art

In order to mount a connector to a connectable plate, the following methods are conventionally used. According to one method, a claw of a jig or the like is hooked on a spring arranged on a connecting portion of the clip connector. Then, the connectable plate is inserted into the widened space between the connecting portion and the spring, and then the claw is removed. In a second method, the connectable plate is forced into the gap between the connecting portion of the connector and the spring arranged thereon, thereby the gap mentioned above is widened, and the connectable plate is inserted into the gap.

In the first conventional method, it is difficult to properly configure the claw of a jig or the like. Further, it is difficult to perform adjustments of the hooking of the claw. In addition, because of limited space, it is difficult to design the structure so as to prevent plastic deformation of the spring. Further, in the second conventional method, if the connectable plate has a sharp edge as in the case of a liquid crystal glass plate, both the connecting portions of the clip connector and the connectable plate may be damaged.

SUMMARY OF THE INVENTION

Accordingly, it is an object of this invention to provide a clip connector that reliably comes into contact with the connectable plate.

Another object of this invention is to provide a clip connector such that when it is connected to the connectable plate there is no damage caused to either the connectable plate or to itself.

In accordance with this invention, there is provided a clip connector, which includes a housing, a plurality of contacts mounted on the housing, and a connectable plate, the connectable plate being connected to each of the contacts; wherein a clip holds together the connectable plate and the housing, which has an inclined portion and a uniform thickness portion; and wherein the opening width of the clip is larger than the thickness of the connectable plate but smaller than the sum of the thickness of the connectable plate and the thickness of the uniform thickness portion.

Further, in accordance with this invention, there is provided a clip connector which includes a housing, a plurality of contacts mounted on the housing, and a connectable plate, the connectable plate being connected to each of the contacts; wherein the spacing of a resilient forked portion of each contact is slightly larger than the thickness of the connectable plate in a direction perpendicular to the direction in which the connectable plate is inserted into each contact in a state in which the connectable plate is inclined with respect to the housing.

DESCRIPTION OF THE PREFERRED EMBODIMENTS

Figure 1C:
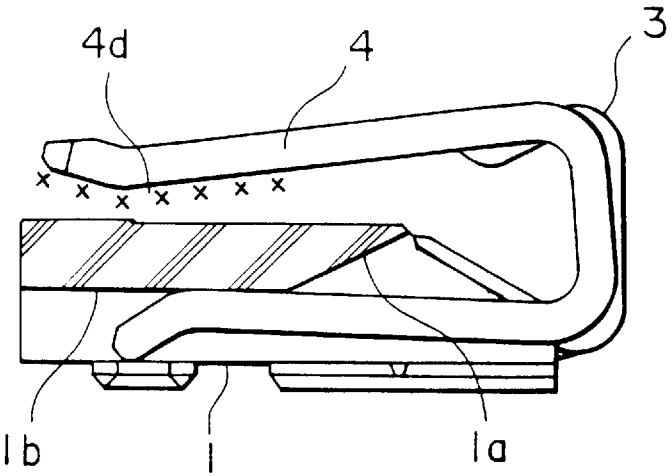
FIG. 1C is an enlarged sectional view taken along the line A—A of FIG. 1B.
Figure 1D:
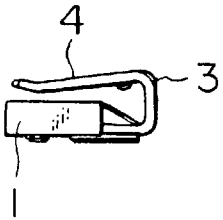
FIG. 1D is a side view of the clip connector according to the first embodiment of this invention.
Figure 1A:
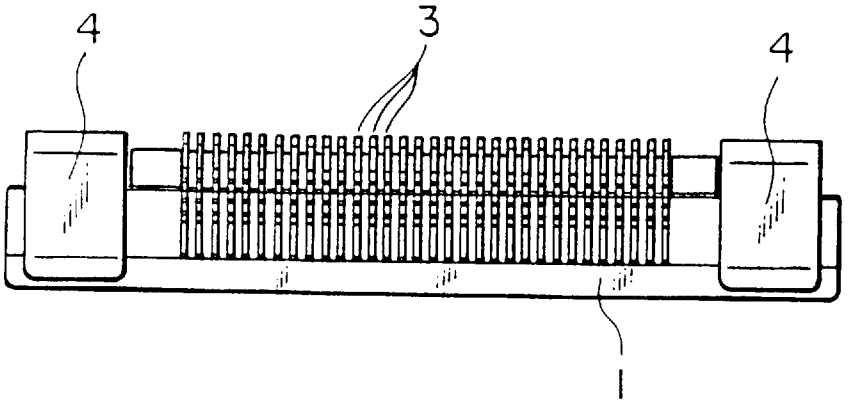
FIG. 1A is a front view of a clip connector according to a first embodiment of this invention.
Figure 1B:
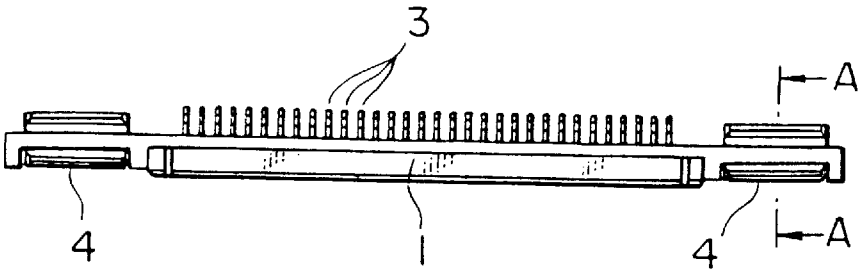
FIG. 1B is a rear elevational view of the clip connector according to the first embodiment of this invention.

Clip connectors according to two embodiments of this invention will be described.

Referring first to FIGS. 1A to 5, a first embodiment of this invention will now be described.

FIGS. 1A to 1D are drawings showing a clip connector according to this first embodiment. To explain the construction more specifically, a plurality of contacts 3 are mounted in a row on a housing 1. A clip 4, having a U-shaped cross-sectional configuration is mounted on either side of the plurality of contacts 3. The clips 4 are detachable with respect to the housing 1 of the clip connector and are employed to support the clip connector with a connectable plate 2, such as a liquid crystal glass plate, which is described below. The housing 1 has an inclined portion 1*a* and a horizontal portion (uniform thickness portion) 1*b* for enabling the clips 4 to be easily mounted.

Figure 2:
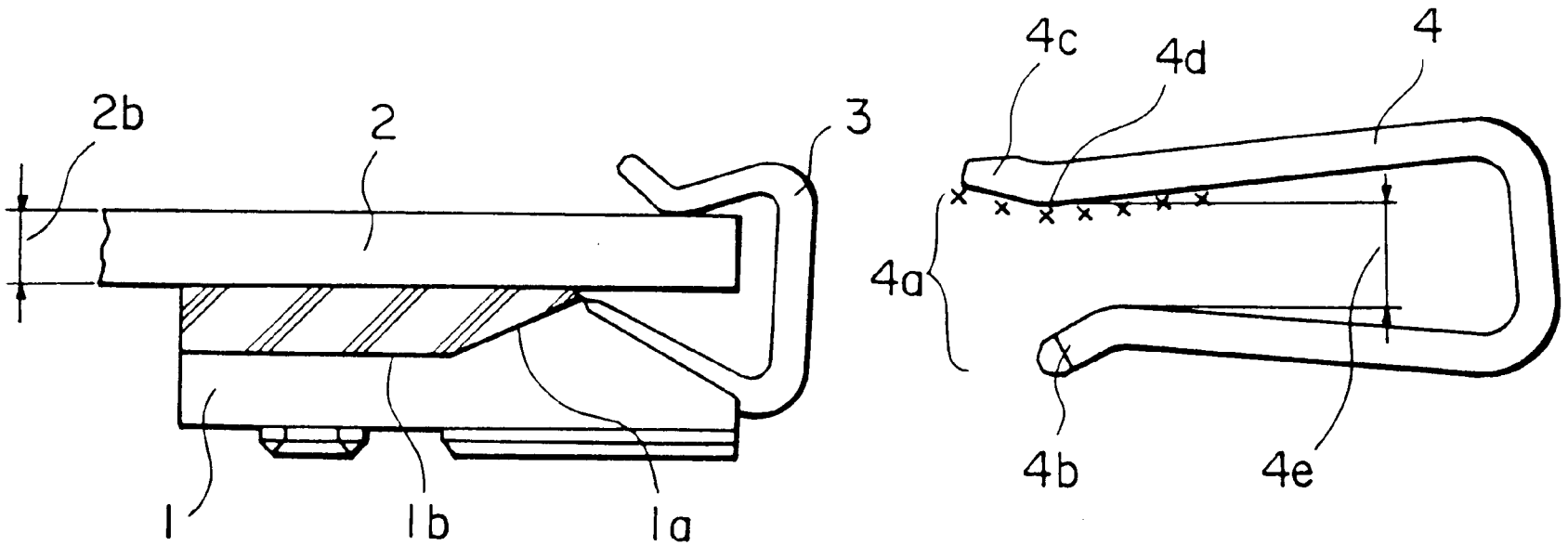
FIG. 2 is a sectional view showing a state in which the clip of the clip connector of the first embodiment of this invention has not yet been mounted to the connectable plate and the housing.

FIGS. 2 to 5 show how a clip 4 is mounted to the housing 1 of the clip connector and the connectable plate 2. Referring to FIG. 2, the gap between a connector-housing-side end portion 4*b* of the clip 4 and an end portion to face the upper surface of the connectable plate 4*c* constitutes a clip opening 4*a*. The opening width 4*e* of the clip opening 4*a* is larger than the thickness of the connectable plate 2*b*, but smaller than the sum of the thickness of the connectable plate 2*b* and the thickness of the portion of the housing 1 to which the clip 4 is mounted (the diagonally shaded portion). An insulating coating portion 4*d* (indicated by marks x) is provided on the portion of the clip 4 which will be in contact with the connectable plate 2 and the peripheral portion.

Figure 3:
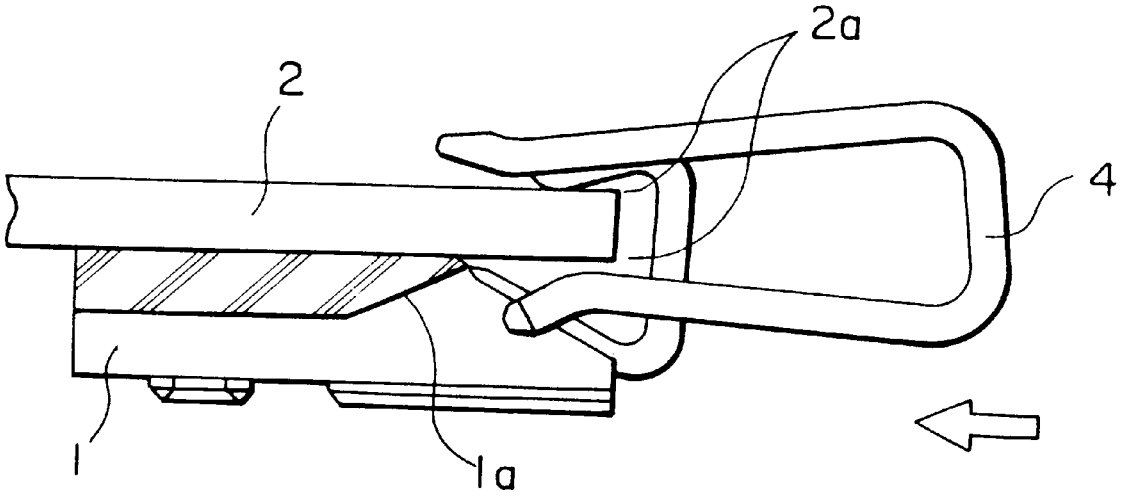
FIG. 3 is a sectional view showing a state of beginning to mount the clip of the clip connector of the first embodiment of this invention to the connectable plate and the housing.

When the clip 4 is moved from the position shown in FIG. 2 in the direction of the arrow shown in FIG. 3, the clip 4 can be mounted to the connectable plate 2 with zero insertion force without touching a sharp edge 2*a* of the connectable plate 2, and no force is applied to the spring of the clip 4 in the process.

Figure 4:
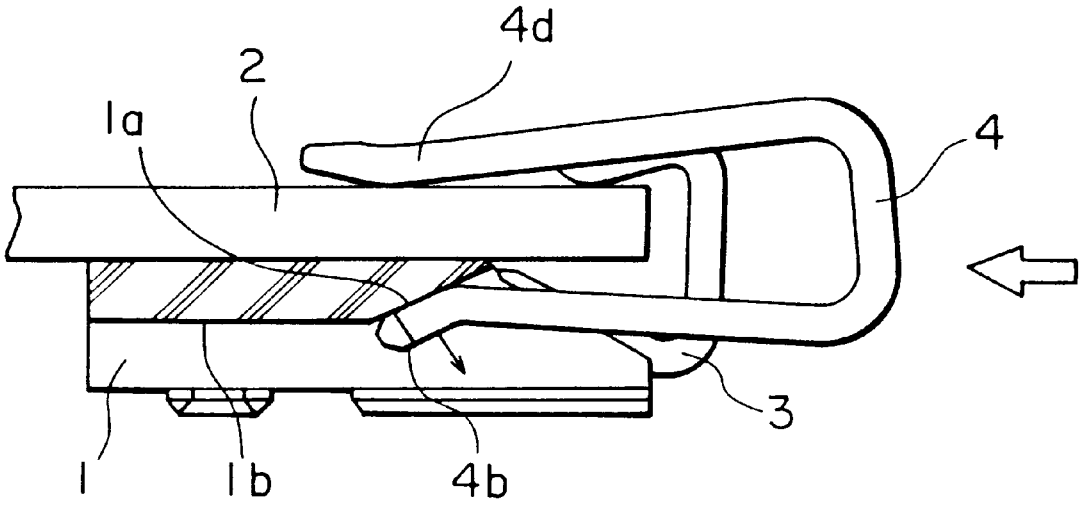
FIG. 4 is a sectional view showing a state of mounting the clip of the clip connector of the first embodiment of this invention to the connectable plate and the housing.

When the clip 4 is moved further in the direction of the arrow shown in FIG. 3, the insulating coating portion 4*d* comes into contact with the surface of the connectable plate 2, as shown in FIG. 4, as a result of a reaction force. In this case, the reaction force is applied to the connector-housing-side end portion 4*b* from the inclined portion 1*a* of the housing 1 in the direction of the arrow.

Figure 5:
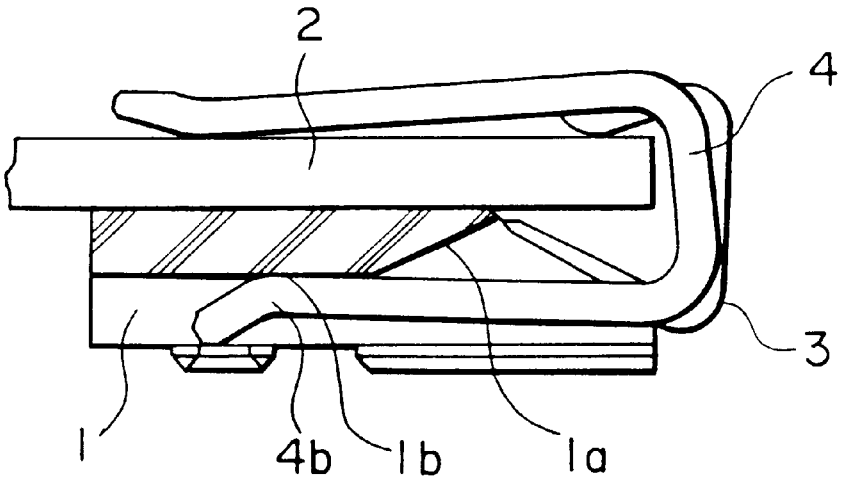
FIG. 5 is a sectional view showing a state in which the clip of the clip connector of the first embodiment of this invention has been mounted to the connectable plate and the housing.

When the clip 4 is moved still further in the direction of the arrow shown in FIG. 4, as shown in FIG. 5, the connector-housing-side end portion 4*b* comes into contact with the horizontal portion 1*b* of the housing 1. In this state, the clip 4 holds together the connectable plate 2 and the housing 1. Further, the connectable plate 2 is in contact with a plurality of contacts 3. In this case, the surface pattern of the connectable plate 2 is not damaged, since the clip 4 has the insulating coating portion 4*d*.

Next, referring to FIGS. 6 to 10D, a second embodiment of this invention will be described.

Figure 6:
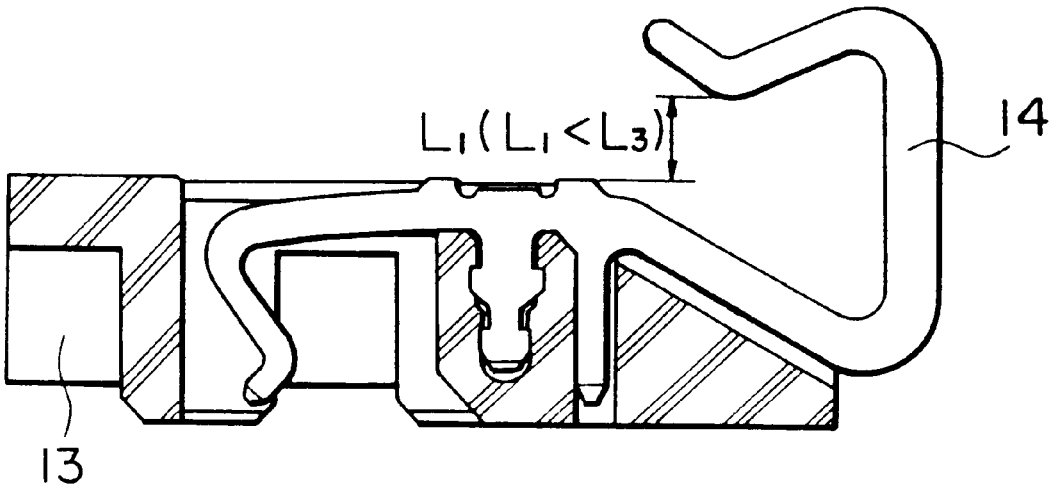
FIG. 6 is a sectional view of a clip connector according to a second embodiment of this invention, showing the relationship between the thickness of a connectable plate and a changeable interval of contacts in a state in which the connectable plate is not fitted in the clip connector.

FIG. 6 is a sectional view of a clip connector according to the second embodiment of this invention, showing the relationship between the thickness of a connectable plate $L_3$ and a changeable interval $L_1$ of contacts 14 when the connectable plate, such as a liquid crystal glass plate, is not fitted in ($L_1<L_3$). A plurality of contacts 14 are mounted in a row on a housing 13.

Figure 7:
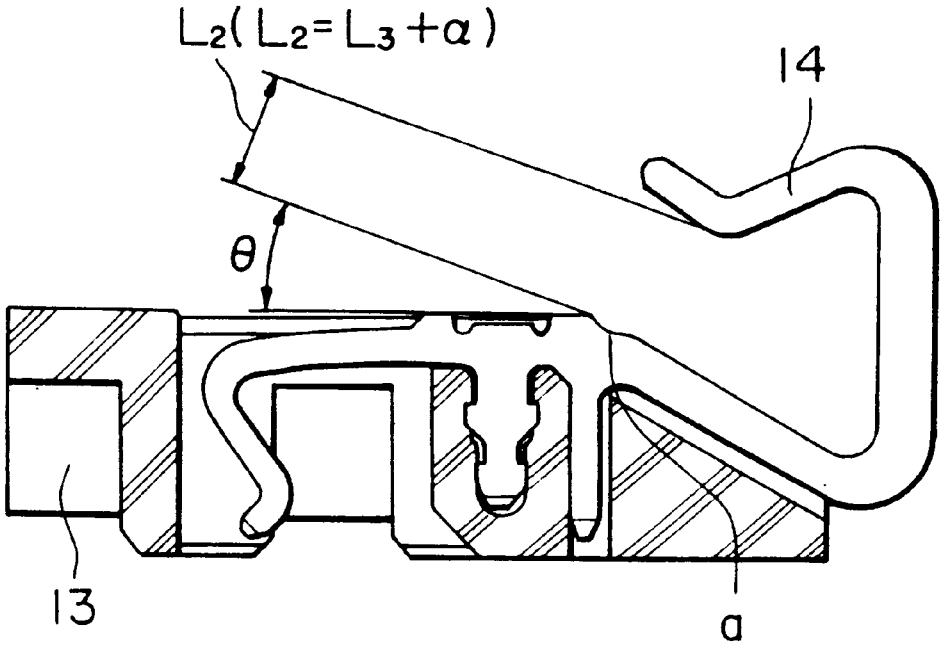
FIG. 7 is a sectional view of the clip connector according to the second embodiment of this invention, showing the spacing of the resilient forked portion of the contacts in a direction perpendicular to the direction in which the connectable plate is inserted into the contacts.

FIG. 7 is a sectional view of the clip connector according to the second embodiment of this invention. The spacing $L_2$of a resilient forked portion of the contacts 14 is larger by $\alpha$ than the thickness of the connectable plate $L_3$ so that the connectable plate can be inserted into the contact 14 with zero insertion force from a direction inclined by $\theta$ with respect to the housing 13.

In the state shown in FIG. 7, the connectable plate 16, such as a liquid crystal glass plate, is inserted into the resilient forked portion of the contacts 14 with zero insertion force from the direction inclined by $\theta$ with respect to the housing 13.

Figure 8:
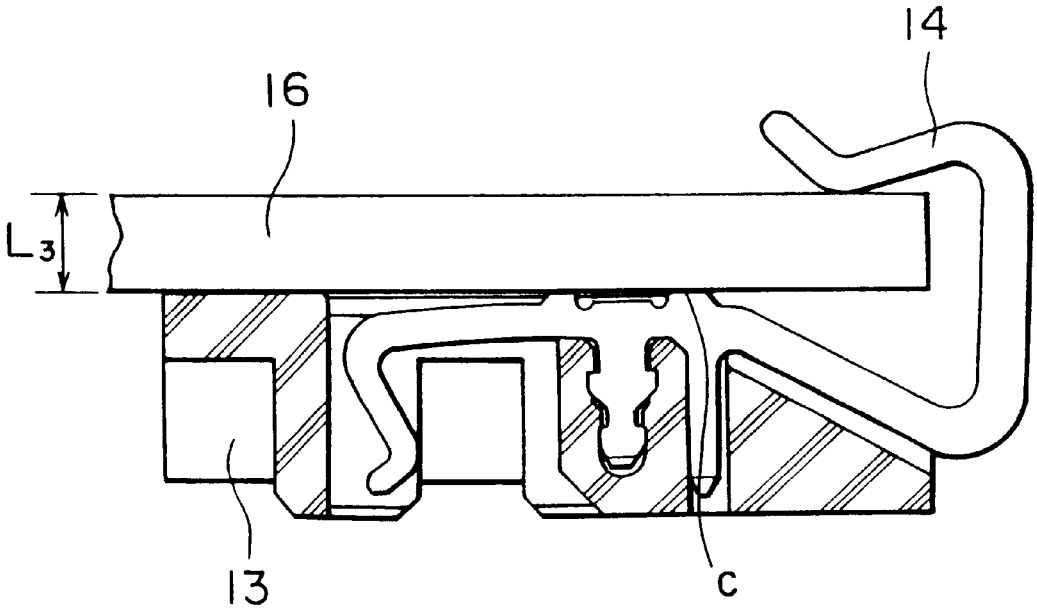
FIG. 8 is a sectional view showing a state in which the clip connector according to the second embodiment of this invention has had the connectable plate fitted in it, with the clip not yet being used.

Then, the connectable plate 16 is rotated counterclockwise about a point a of the contacts 14 to the horizontal position shown in FIG. 8. Then, a desired contact force is obtained between the contact point c positioned somewhat outside the point a of the contacts 14 and the connectable plate 16. As a result, the connectable plate 16 and the contacts 14 can be connected without any damage caused to the patterns, etc., on the connectable plate or to the contacts 14 of the connector.

Figure 9:
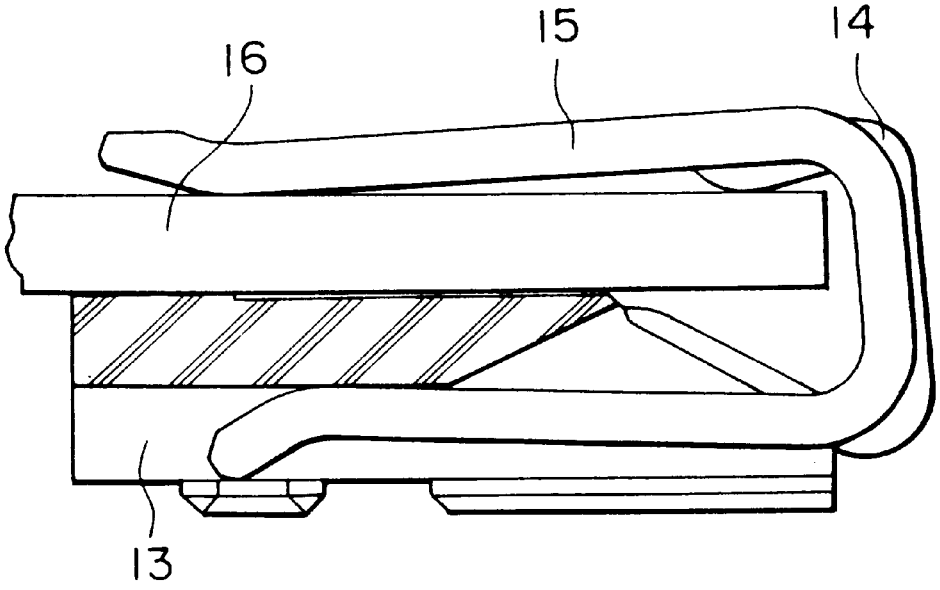
FIG. 9 is a sectional view showing a state in which the clip connector of the second embodiment of this invention has had the connectable plate fitted in it, with the clip being used.
Figure 10C:
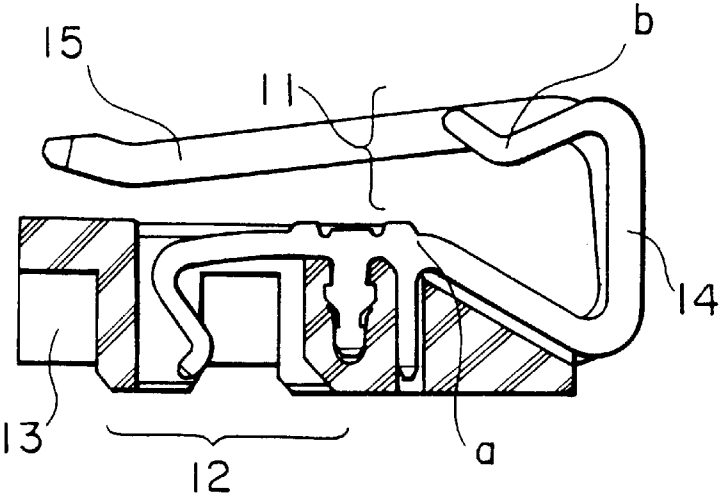
FIG. 10C is an enlarged sectional view taken along the line A—A of FIG. 10B.
Figure 10D:
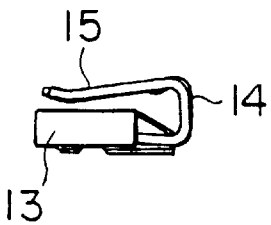
FIG. 10D is a side view of the clip connector according to the second embodiment of this invention.
Figure 10A:
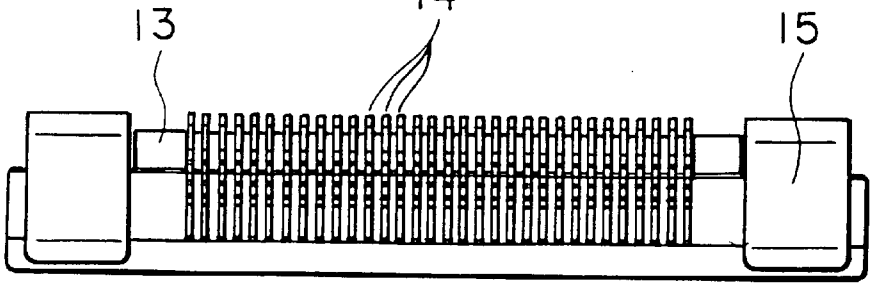
FIG. 10A is a front view of the clip connector according to the second embodiment of this invention.
Figure 10B:
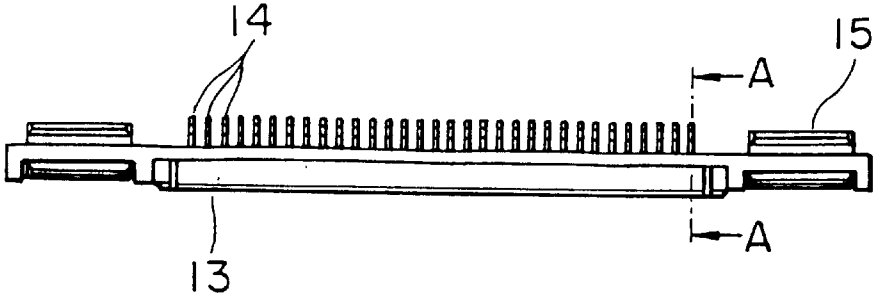
FIG. 10B is a rear elevational view of the clip connector according to the second embodiment of this invention.

In the state shown in FIG. 8, however, when the external force which biases the connectable plate 16 in the counterclockwise direction is cancelled, the connectable plate 16 is caused to rotate clockwise because of the spring force of the contacts 14. To prevent such clockwise rotation of the connectable plate 16, a clip 15, as shown in FIG. 9, is employed. The cross-sectional configuration of the clip 15 is U-shaped. The connector is fixed to the connectable plate 16 by means of holding the housing 13 of the connector together with the connectable plate 16. Thus, the connector holds the connectable plate 16 in a desired fitted-in state.

FIGS. 10A to 10D are drawings showing the clip connector according to the second embodiment. To explain the construction more specifically, the connectable plate 16 and the contacts 14 of the clip connector are connected at a connecting portion 11. The thickness of the connectable plate 16 is somewhat smaller than the narrow spacing between a point a positioned near the gate of the contacts 14 and a point b so that the connectable plate 16 can be inserted into the resilient forked portion of the contact 14 with zero insertion force from the direction inclined by $\theta$ with respect to the housing 13. This clip connector and the associated connectors fit in together at a fit-in portion 12. A plurality of contacts 14 are mounted in a row on the housing 13. A clip 15 is arranged at either end of the plurality of contacts 14. The clip 15 is detachable with respect to the housing 13. The clip 15 is employed in order to support the clip connector in the position shown in FIG. 9 with respect to the connectable plate 16.

Instead of the clip 15 described above, a clip having another construction may be employed so that the connectable plate 16 may be engaged with the housing 13 in parallel thereto.

As is apparent from the above description, this invention provides the following advantages:

1. The clip connector can be connected to the connectable plate without any damage being caused to the connectable plate or to the clip connector. Thus, this clip connector is useful for the connection of a connectable plate such as a liquid crystal glass plate or a liquid crystal film plate, in which the surfaces are liable to be damaged and on which there is a sharp edge.

2. By using the clip, the clip connector can be easily connected to the connectable plate.

What is claimed is:

1. A clip connector comprising a housing, a plurality of contacts mounted on said housing, and a connectable plate, said connectable plate having a predetermined thickness and being connected to each of said plurality of contacts, wherein a clip holds together said connectable plate and said housing, said housing having a first and inclined portion followed by a second and uniform thickness portion, said inclined housing portion extending from substantially a lower surface to substantially an upper surface of said second portion, and said clip having an opening with a width which is larger than the predetermined thickness of said connectable plate but smaller than a sum of the predetermined thickness of said connectable plate and the thickness of said uniform thickness portion, said inclined portion guiding and directing said clip into a clamping position on said second portion.

2. A clip connector as claimed in claim 1, further comprising an insulating coating portion provided in the portion of said clip which is in contact with said connectable plate.

3. A clip connector as claimed in claim 1, wherein said connectable plate comprises a liquid crystal plate.

4. A clip connector as claimed in claim 1, wherein said connectable plate is fixed to said housing in parallel thereto by means of said clip.

5. A clip connector as claimed in claim 4, wherein the cross-sectional configuration of said clip is U-shaped, and wherein said clip holds together said connectable plate and said housing.

6. A clip connector as claimed in claim 4, wherein said clip is detachable with respect to said housing.

* * * * *